US005127644A

United States Patent [19]

Yoshihiro et al.

[11] Patent Number: 5,127,644

[45] Date of Patent: Jul. 7, 1992

[54] PAPER-SUPPLYING DEVICE FOR AN IMAGE-FORMING APPARATUS

[75] Inventors: Takeo Yoshihiro, Neyagawa; Hiroyoshi Ohmura, Osaka; Kazuo Nakamura, Yamatotakada; Osamu Yoshimura, Hirakata; Masayuki Mizuno, Osaka, all of Japan

[73] Assignee: Mita Industrial Co., Ltd., Osaka, Japan

[21] Appl. No.: 552,690

[22] Filed: Jul. 12, 1990

[30] Foreign Application Priority Data

Jul. 16, 1989 [JP] Japan ..... 1-83192[U]
Jul. 27, 1989 [JP] Japan ..... 1-88987[U]

[51] Int. Cl.[5] ..... B65H 3/06

[52] U.S. Cl. ..... 271/10; 271/121; 271/251

[58] Field of Search ..... 271/10, 121, 250, 251, 271/274; 355/316, 308; 358/296, 400, 401, 488

[56] References Cited

U.S. PATENT DOCUMENTS 3,387,907 6/1968 Wall .
3,768,805 10/1973 Kuksa .
4,098,501 7/1978 Tani et al. .
4,351,519 9/1982 Jendrick .
4,548,397 10/1985 Runzi ..... 271/121
4,748,516 5/1988 Harano ..... 358/296
4,835,567 5/1989 Ogata .
4,953,037 8/1990 Ito ..... 358/488 X

FOREIGN PATENT DOCUMENTS 58-125538 7/1983 Japan .
59-186841 10/1984 Japan .
60-223747 11/1985 Japan .
1-176737 7/1989 Japan .

*Primary Examiner*—Richard A. Schacher
*Attorney, Agent, or Firm*—Wenderoth, Lind & Ponack

[57] ABSTRACT

A conveying roller conveying a paper has a stepped structure with the diameter of portion positioned at the middle in the axial direction of the conveying roller slightly larger than that on opposite sides or ends of the conveying roller. The center in the axial direction of such middle portion almost coincides with the center in the axial direction of a paper-supplying roller positioned upstream of the conveying roller. The promotion of the inclined conveyance of paper resulting from inclined supplying to the conveying roller is prevented, particularly in the case of a one-end standard paper-supplying mode wherein one side end in the direction of the width of paper is regulated by a paper-supplying guide. The middle roller portion is displaced axially toward the side of the paper-supplying guide. The forces of two springs for urging an image-read out device toward the conveying roller to be almost equal to each other. The distance in the axial direction from the center of the middle portion of the conveying roller to the spring disposed on the side opposite to the paper-supplying guide is slightly larger than the distance from such center to the spring disposed on the side of the paper-supplying guide.

3 Claims, 4 Drawing Sheets

PAPER-SUPPLYING DEVICE FOR AN IMAGE-FORMING APPARATUS

FIELD OF THE INVENTION

The present invention relates to a paper-supplying device for use in an image-forming apparatus such as a facsimile machine and a printer.

DESCRIPTION OF THE PRIOR ART

A known paper-supplying device for use in, for example, a facsimile machine, includes an image reader energizedly engaged with, i.e. urged toward, conveying roller conveying papers, such as manuscripts, that are controlled by means of a paper-supplying guide at one side end in the direction of the width of the papers. The image reader is urged toward the conveying roller by two springs disposed at a suitable interval in the longitudinal direction thereof. A paper-supplying roller supplying the papers at midway portions in the direction of the width thereof and capable of being switched over to a nondriven condition during the time when the papers are being conveyed by means of the conveying roller and an overlapped conveyance-preventing member energizedly engaged with the paper-supplying roller are provided on the upstream side of the conveying roller.

With the paper-supplying device having the above described construction, the papers controlled by means of the paper-supplying guide at one side end in the direction of the width thereof are supplied sequentially one at a time by the cooperation of the paper-supplying rollers and the overlapped conveyance-preventing member. Additionally the papers are conveyed by means of the conveying roller and the image reader. Also, the paper-supplying rollers are switched over to the nondriven condition during the time when the papers are being conveyed by means of the conveying roller, and the frictional resistance resulting from the overlapped conveyance-preventing member is imparted to the papers, whereby the papers are pulled by means of the conveying roller.

However, as shown in FIG. 6, the conveying posture of a paper P supplied by a paper-supplying roller 31 frequently has been misaligned in that paper P may be supplied in a slightly inclined condition. Thus, a problem has occurred in that the conveying force resulting from a conveying roller 33 acts in a biased manner on one side end corner portion of a leading or pointed end of the paper P while frictional resistance resulting from an overlapped conveyance-preventing member 32 is imparted to a midway portion in the direction of the width of the paper P. Thus, a force F bending or turning the paper P toward one side end in the direction of width of the paper P acts on the paper P in a first stage of conveyance to still further promote the inclined supply of paper P and thus to be apt to lead to a poor paper supply.

Such a problem has occurred in not only the above described paper-supplying device adopting a so-called one end-standard paper-supplying mode, in which the papers are regulated by means of the paper-supplying guide at one side end in the direction of the width thereof, but also a paper-supplying device adopting a so-called center-standard paper-supplying mode in which the papers are regulated by means of paper-supplying guides at both ends in the direction of the width thereof.

SUMMARY OF THE INVENTION

The present invention has been achieved with the above described matters in mind, and it is an object of the present invention to provide a paper-supplying device capable of effectively suppressing the above described inclined paper supply and thus of supplying the papers under desirable conditions by remarkably simple and rational improvements.

In order to achieve the above described object, in a first aspect of the invention a paper-supplying device in an image-forming apparatus comprises an image-read out device energizedly engaged with or urged toward a conveying roller conveying papers to be supplied throughout the width thereof. A paper-supplying roller or rollers supply the papers at midway portions in the direction of the width of the papers and are capable of being switched to a nondriven condition during a time when the papers are being conveyed by means of the conveying roller and an overlapped conveyance-preventing member energizedly engaged with or urged toward the paper-supplying roller. The paper-supplying roller and the overlapped conveyance-preventing member are disposed on the upstream side of the conveying roller. The conveying roller is formed so that a diameter of a middle portion thereof, in the axial direction thereof, has a diameter slightly larger than that of portions on opposite ends or sides thereof. A center in the axial direction of the middle portion almost coincides with a center in the axial direction of the paper-supplying roller.

According to the features of the invention described above, when paper is supplied to the conveying roller in an inclined posture or manner, one side end corner portion of a leading end of the paper is supplied by a roller portion on an end or sides in the axial direction of the conveying roller. However, the diameter of the portion positioned at the middle of the conveying roller is slightly larger than the diameter of the portions on opposite sides thereof, so that the conveying force on opposite sides of the conveying roller is smaller than that at the middle portion thereof. Thus, the paper can be prevented from being turned or skewed in a direction toward one side end thereof in the first stage of the conveyance by means of the conveying roller, even though the frictional resistance resulting from the overlapped conveyance-preventing member is applied to the middle portion in the direction of the width of the paper.

The portion in the vicinity of the center of the leading end of the paper supplied in an inclined manner is conveyed by the middle portion of the conveying roller. But the center in the axial direction of the middle portion of the conveying roller almost coincides with the center in the axial direction of the paper-supplying roller. Therefore, even through the paper is turned in the direction toward one side end thereof, the extent of such turning is remarkably small.

Consequently, according to the above described feature of the invention, the paper can be effectively prevented from being supplied in an inclined manner, and thus the paper can be supplied under desirable conditions.

In addition, a second aspect of the invention relates to a paper-supplying device adopting the one end-standard paper-supplying mode.

That is, a paper-supplying device in an image-forming apparatus includes an image-read out device energizedly engaged with a conveying roller, conveying paper that is regulated by a paper-supplying guide at one side end in the direction of the width thereof throughout the width thereof by two springs spaced in the longitudinal direction thereof. A paper-supplying roller supplies the paper at a midway portion in the direction of the width of the paper and is capable of being switched-over to a nondriven condition during the time when the paper is being conveyed by the conveying roller and an overlapped conveyance-preventing member energizedly engages with the paper-supplying roller. The paper-supplying roller and the overlapped conveyance-preventing member are disposed on the upstream side of the conveying roller. The diameter of a middle portion in the axial direction of the conveying roller is slightly larger than that of opposite end portions thereof. The middle portion is biased toward a paper-supplying guide. Energizing forces of the two springs are set to be almost equal to each other. A distance from the center in the axial direction of the middle portion of the conveying roller to the spring disposed on the side opposite to the paper-supplying guide is slightly larger than that from such center in the axial direction of the middle portion of the conveying roller to the spring disposed on the side of the paper-supplying guide. The center in the axial direction of the middle portion of the conveying roller almost coincides with the center in the axial direction of the paper-supplying roller.

Also, according to this second aspect of the invention, the paper can be effectively prevented from being supplied in an inclined manner. Thus, the paper can be supplied under desirable conditions in the same manner as in the first aspect of the invention. The second aspect of the invention exhibits the following additional effects.

Two springs are arranged at positions nearly equally distant from the middle portion of the conveying roller, while the middle portion of the conveying roller is biased toward the side of the paper-supplying guide. Thus, papers will be conveyed at portions thereof in the vicinity of the center thereof in the direction of the width thereof, even though the papers are of different size. Thereby, the image-read out device can be pressed against the middle portion of the conveying roller at an almost uniform pressure.

Also, the support of the image-read out device by means of the springs is unbalanced. Thereby, a portion of the image-read out device on the side opposite to the paper-supplying guide and tending to freely hang downwardly can be prevented from doing so with hardly any change of the force pressing the image-read out device against the middle portion of the conveying roller, by providing a slight difference between the distances from the middle portion of the conveying roller to the two springs.

BRIEF DESCRIPTION OF THE DRAWINGS

One preferred embodiment of the present invention is shown in FIGS. 1 to 4, in which.

DESCRIPTION OF THE PREFERRED EMBODIMENTS

Preferred embodiments of the present invention will be below described with reference to the drawings.

Figure 1:
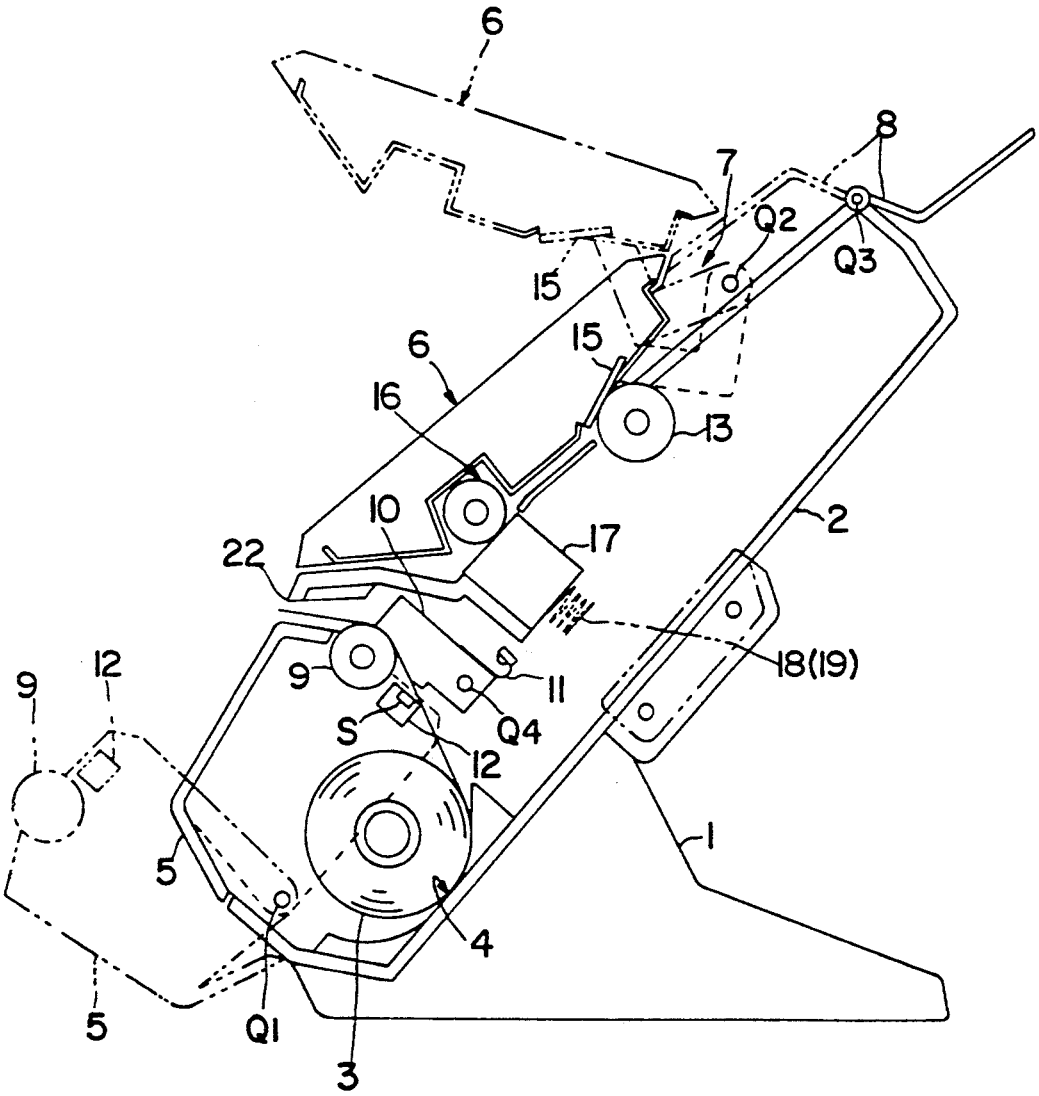
FIG. 1 is a longitudinally sectioned side view schematically showing a facsimile machine as one example of an image-forming apparatus.

FIG. 1 shows a facsimile machine as one example of an image-forming apparatus longitudinally arranged on a trestle 1 so as to be lowered backwards. Reference numeral 2 designates a body of the apparatus provided at a lower side thereof with a holder member 4 for a roll of paper 3 (for example heat-sensitive transfer paper). A lower cover 5 covers holder member 4 and is pivotably mounted on body 2 of the apparatus so as to freely swing and be closed around an axis shaft $Q_1$ on the lower end of body 2. A front cover 6 is provided with a dial and various kinds of operating buttons and the like and is pivotably mounted on a front surface of body 2 so as to freely swing and be closed around an axis shaft $Q_2$ at an upper end of body 2. An upper cover 8, covering a paper-supplying portion 7 comprising an upper side of front cover 6 and the body 2, is pivotably installed so as to freely swing and be closed around an axis shaft $Q_3$ on the upper end of body 2.

Reference numeral 9 designates a paper-pressing roller provided on a free end side of lower cover 5. Reference numeral 10 designates an image-forming device forming a received image on the paper 3, image-forming device 10 being pivotably mounted on the body 2 so as to be freely rotated by an appointed angle around an axis shaft $Q_4$ parallel to axis shaft $Q_1$ of the lower cover 5. Image-forming device 10 is provided with a plate spring 11 for energizedly pressing an image-forming portion thereof against paper-pressing roller 9 when the lower cover 5 is closed. (S) designates a paper sensor installed on the lower cover 5 by a fitting member 12.

Figure 2:
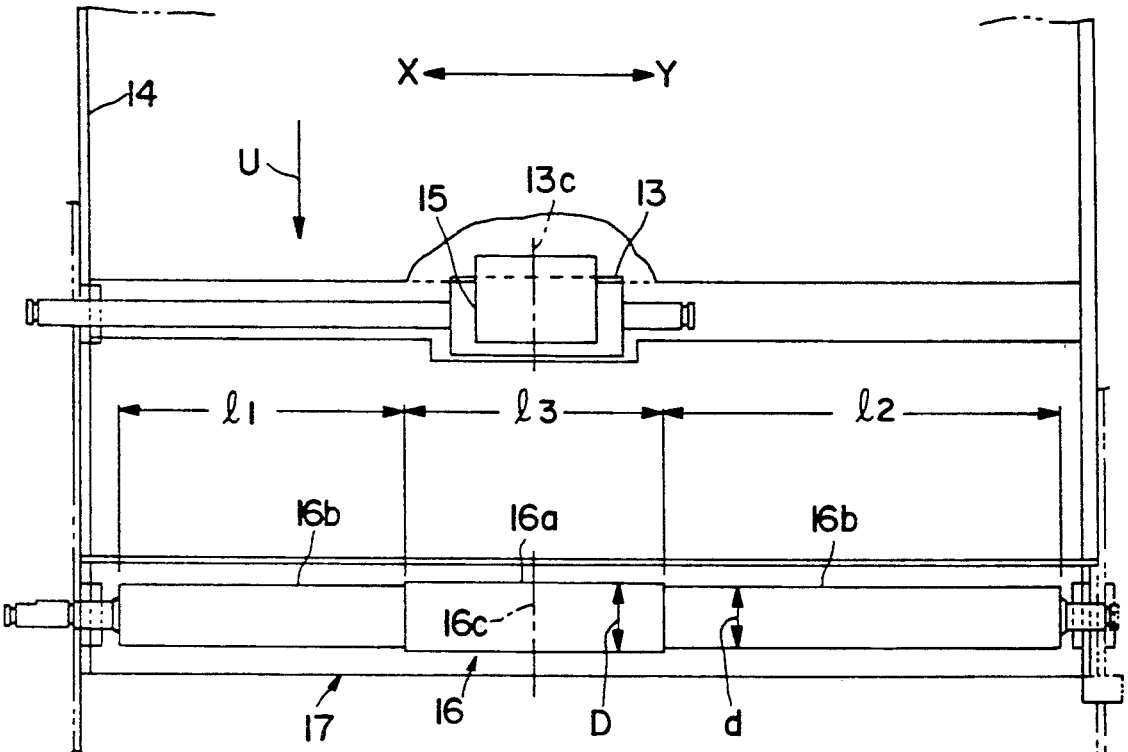
FIG. 2 is a plan view showing the positional relation between a paper-supplying roller and a conveying roller.

Reference numeral 13 designates a paper-supplying roller provided in the vicinity of a paper-supplying port of paper-supplying portion 7. Paper-supplying roller 13 engages with a mid-portion, in the direction of width, of a paper (for example a manuscript) which is supplied along a paper-supplying guide 14 at one side end in the direction of the width thereof (the direction X-Y), to convey such paper, as shown in FIG. 2. Reference numeral 15 designates an overlapped conveyance-preventing member to be engaged with paper-supplying roller 13 for preventing the overlapped conveyance of papers. Overlapped conveyance-preventing member 15 has a width slightly smaller than that of the paper-supplying roller 13 and is mounted on the front cover 6.

Figure 3:
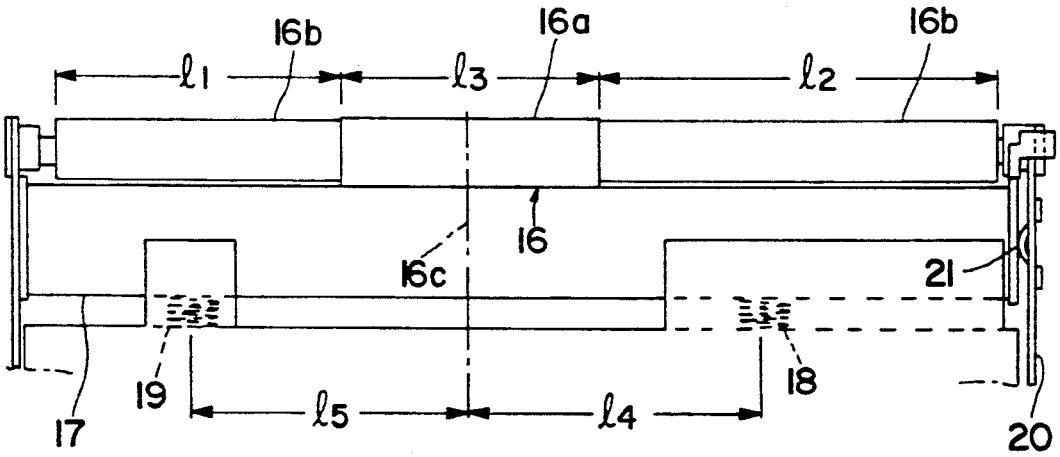
FIG. 3 is a diagram showing the positional relation among the conveying roller, an image read out device and springs.

Reference numeral 16 designates a conveying roller rotatably mounted above an upper portion of the image-forming device 10. Reference numeral 17 designates an image-read out device (light sensor) energizedly engaged with, i.e. urged toward, conveying roller 16 by two springs (for example coil springs) 18, 19 arranged at a suitable interval in the longitudinal direction (the same direction as direction X-Y) and pressed toward one end side (the left end side as seen in the drawings) in the longitudinal direction by means of a plate spring 21 fitted on a side plate 20 on the side of the body 2, as shown in FIG. 3. In addition, reference numeral 22 designates a cutter for cutting the paper 3.

Conveying roller 16 is engaged with the paper, which has been supplied by means of the paper-supplying roller 13 and the paper-supplying guide 14 in the so-called one end-standard mode, to convey the paper. In addition, the image-read out device 17 reads out an image formed on the paper in the midst of such conveyance to convert the read-out image into an image signal and send such image signal to a facsimile machine at a communicating party. The paper-supplying roller 13 can be switched over to the nondriven condition to be passively rotated by the drag of the paper conveyed by means of the conveying roller 16 during the time when the paper is being conveyed by means of the conveying roller 16.

With the above described construction, upon receiving an image signal sent from the facsimile at the communicating party, the image-forming device 10 is operated and simultaneously the paper-pressing roller 9 is rotated to form the received image on the paper 3. After the completion of such receipt, the paper 3 is drawn off along the cutter 22 to obtain a sheet on which the received image has been formed.

During transmission of an image to the facsimile machine at the communicating party, the upper cover 8 for preventing the conveying roller 16 and the image-read out device 17 from being stained and improving the light resistance of the conveying roller 16 is opened so as to open the paper-supplying portion 7 between the body 2 and the front cover 6. The paper (manuscript) having the image to be transmitted is supplied between the paper-supplying roller 13 and the overlapped conveyance-preventing member 15 along the paper-supplying guide 14 at one side end in the direction of the width thereof from the paper-supplying portion 7, thereby supplying the image-read out device 17 with the papers one by one under the condition that overlapped conveyance is prevented. Thereby, the image on the paper and to be conveyed is read out by means of the image-read out device 17 with the paper between the conveying roller 16 and the image-read out device 17. Thus, the image signal is transmitted to the facsimile machine at the communicating party.

In a facsimile machine adopting the one end-standard paper-supplying mode having the above described construction, the conveying roller 16 has the following stepped structure.

That is to say, as shown in FIG. 2, an outside diameter D of a middle portion **16*a* in the axial direction of the conveying roller 16 is slightly larger than an outside diameter d of portions 16*b* on opposite sides of portion 16*a*. Thus, middle portion 16*a* will play the leading role in the conveying operation. The middle portion 16*a* is slightly biased toward the side of the paper-supplying guide 14, so that papers having different sizes supplied by the one end-standard mode will be conveyed at the vicinity of the center in the direction of the width thereof. The center 16*c* in the axial direction of the middle portion 16*a* almost coincides with the center 13*c* in the axial direction of the paper-supplying roller 13 in the paper-supplying direction (the direction shown by an arrow U in FIG. 2**).

More specifically, when for example papers of A4 size having a width of 210 mm and papers of B5 size having a width of 182 mm, which generally are most frequently used, are to be supplied by the one end-standard mode, a length $l_1$ in the axial direction of the portion **16*b* on the side closer to the paper-supplying guide 14 is set at 66 mm, a length $l_2$ in the axial direction of the other portion 16*b* is set at 94 mm, a length $l_3$ in the axial direction of the middle portion 16*a* is set at 60 mm, and a difference in radius between the middle portion 16*a* and the portions 16*b* (D/2-d/2) is set at 0.3 to 0.1 mm. For papers of A4 size, the center in the direction of width of the paper is positioned slightly toward the side opposite to the paper-supplying guide 14 from the center 16*c* in the axial direction of the middle portion 16*a*. For papers of B5 size, the center in the direction of width of the paper is positioned slightly toward the side of the paper-supplying guide 14 from the center 16*c* in the axial direction of the middle portion 16*a***.

Figure 4:
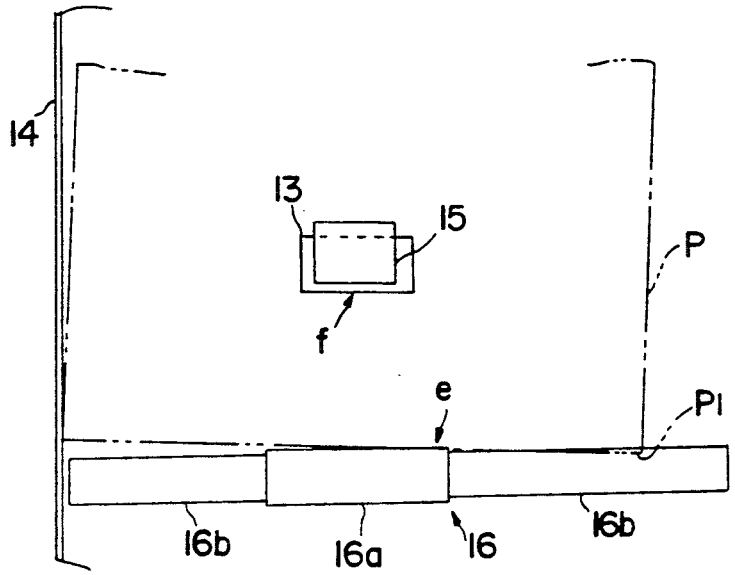
FIG. 4 is a diagram showing the conveyance of a paper.

With the above described construction, as shown in FIG. 4, in the case where the paper P is supplied to the conveying roller 16 in an inclined orientation, at first a pointed end corner portion $P_1$ of the paper P receives the conveying force by one (on the right side in the drawing) of the roller portions **16*b*. However, the outside diameter of this roller portion 16*b* is slightly smaller than that of the middle roller portion 16*a*, so that the conveying force by this roller portion 16*b* is weaker than that by the middle roller portion 16*a*. Accordingly, even though a frictional resistance resulting from the paper supplying roller 13 under the nondriven condition and the overlapped conveyance-preventing member 15** is applied to the midway portion of the paper P in the direction of the width thereof, a force bending or turning the paper P toward one side end in the direction of the width of the paper P is not applied to the paper P. Even if such force is applied to the paper, it is remarkably small and thus the inclined supply of the paper P can be effectively suppressed.

Subsequently, paper P, which has been supplied in an inclined orientation, is conveyed by means of the middle roller portion **16*a* at the vicinity of the central portion of the leading end thereof. However, the frictional resistance resulting from the paper-supplying roller 13 and the overlapped conveyance-preventing member 15 is applied to the paper surface behind the location where the conveying action by the middle roller portion 16*a* is conducted, and the center 16*c* in the axial direction of the middle roller portion 16*a* almost coincides with the center 13*c* in the axial direction of the paper-supplying roller 13 in the paper-supplying direction. Therefore, a point (e) on the paper P, where the conveying action is conducted, almost coincides with the point (f) on the paper P where the frictional resistance is imparted, in the paper-supplying direction. Accordingly, even if the paper P is turned toward one side in the direction of the width thereof by middle roller portion 16*a***, the extent of turning is remarkably small and thus the promotion of the inclined supply of the paper P leading to poor paper supply can be effectively suppressed.

The two springs 18, 19 urging image-read out device 17 against the conveying roller 16 are generally arranged at equal distances with the center in the longitudinal direction of the image-read out device 17. Thus, under the condition that the middle roller portion **16*a* is positioned closer to the side of the paper-supplying guide 14, the force pressing the image-read out device 17 against the middle roller portion 16*a*** may be unbalanced, so that inclined conveyance may occur.

Image-read out device 17 can be pressed against the middle roller portion 16*a* at a uniform pressure by making the energizing forces of two springs 18, 19 different from each other. However, in such case two different kinds of springs 18, 19 are required, and thus there is the possibility that the control of the incorporation of the two springs 18, 19 is troublesome and the cost is increased.

Thus, according to the present invention the energizing forces of the two springs 18, 19 are set so as to be almost equal to each other and the two springs 18, 19 are arranged at almost equal distances from the center 16*c* in the axial direction of the middle roller portion 16*a*. Therefore, the image-read out device 17 can be pressed against the middle roller portion 16*a* at an almost equal pressure, while the control of the incorporation of the springs 18, 19 is easy and also the cost is reduced.

However, if the energizing forces of the two springs 18, 19 are set so as to be almost equal to each other and the two springs 18, 19 are arranged at equal distances from the center 16*c* in the axial direction of the middle roller portion 16, the fulcrums of the two springs 18, 19 against the image-read out device 17 are biased. Thus, there is the possibility that the portion of the image-read out device 17 on the side opposite to the paper-supplying guide 14 freely hangs down and the conveying capacity is slightly spoiled.

Therefore, according to the present invention, as shown in FIG. 3, a distance $l_4$ from the center 16*c* in the axial direction of the middle roller portion 16*a* to the spring 18 on the side opposite to the paper-supplying guide 14 is set so as to be slightly larger than a distance 5 from the center 16*c* in the axial direction of the middle roller portion 16*a* to the spring 19 on the side of the paper-supplying guide 14. Thereby, the portion of the image-read out device on the side opposite to the paper-supplying guide 14 is prevented from hanging down with hardly any change of the energizing force of the image-read out device 17 against the middle roller portion 16*a*.

More specifically, the lengths $l_1$, $l_2$, $l_3$ in the axial direction of the portions 16*a*, 16*b* of the conveying roller 16 are set in the above described manner and distances $l_4$, $l_5$ are set at 69 mm and 67 mm, respectively, so that there is a difference ($l_4$–$l_5$) of 2 mm between the distance from the center 16*c* to the spring 18 and the distance from the center 16*c* to the spring 19.

However, it goes without saying that the above specific lengths of $l_1$, $l_2$, $l_3$ and the difference between the diameters D, d and the difference ($l_4$–$l_5$) are illustrative only.

Further, although the conveying roller 16 having the stepped structure with middle roller portion 16*a* positioned toward the paper-supplying guide 14 was described above with regard to a so-called one-end standard paper-supplying mode as the object in the above described preferred embodiment, the present invention can be applied also to a so-called center standard paper-supplying mode in which the center in the direction of the width of the paper coincides with the center 16*c* in the axial direction of the middle roller portion 16*a*.

Figure 5:
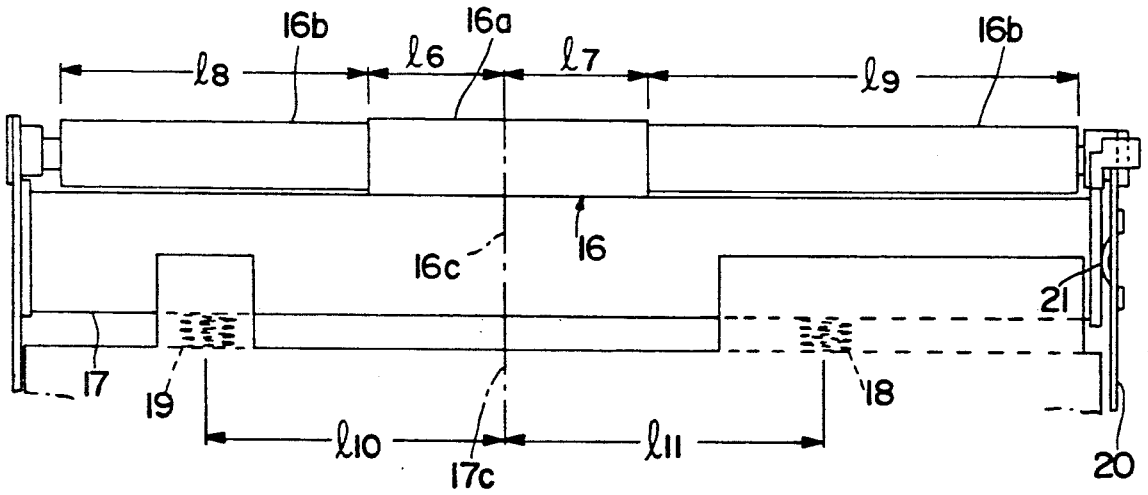
FIG. 5 is a diagram showing the positional relation among a conveying roller, an image read out device and springs according to another preferred embodiment of the present invention.
Figure 6:
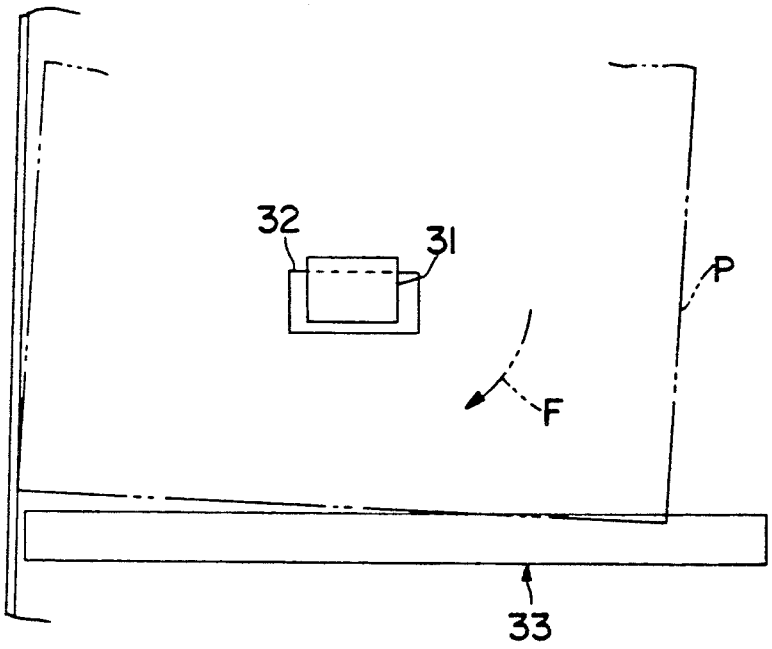
FIG. 6 is a diagram showing the conveyance of a paper according to the prior art.

FIG. 5 shows the positional relation among a conveying roller 16, an image-read out device 17 and springs 18, 19 in the case where such center standard paper-supplying mode is adopted. In this case, a center 16*c* in the axial direction of a middle portion 16*a* of conveying roller 16 coincides with a center 17*c* in the axial direction of image-read out device 17. Roller portions 16*b* are on opposite sides of middle roller portion 16*a*. Two springs 18, 19 press the image-read out device 17 against the conveying roller 16 and are positioned at equal distances on opposite sides of center 17*c* in the axial direction of image-read device 17. That is to say, referring to FIG. 5 and with respect to sizes $l_6$ to $l_{11}$, $l_6=l_7$, $l_8<l_9$, $l_{10}=l_{11}$.

As above described, according to the present invention, the promotion or accentuation of the inclined conveyance of paper resulting from the misaligned supply to the conveying roller of the paper can be effectively prevented, and even paper supplied in a slightly inclined manner can be satisfactorily conveyed by the simple improvement that the outside diameter of the roller portions on opposite ends or sides of the conveying roller is slightly smaller than that of the middle roller portion, thereby slightly weakening the force of the side roller portions conveying the paper. Also according to the present invention, the promotion of the inclined conveyance of the paper resulting from the misaligned supply to the conveying roller of the paper can be effectively prevented, and even paper supplied in the slightly inclined manner can be satisfactorily conveyed by making the appropriate conveyance of the paper at the vicinity of the center in the direction of the width thereof possible and slightly weakening the force conveying the paper of the roller portions on opposite sides of the conveying roller, even though the paper is supplied by the so-called one-end standard mode, in which the middle roller portion is positioned toward the side of the paper-supplying guide. In addition, the image-read out device can be energizedly pressed against the middle roller portion at an almost uniform pressure. Thus, the reduction of the conveying capacity resulting from the biased disposition of the middle roller portion toward the side of the paper-supplying guide can be effectively prevented, without the portion of the roller on the side opposite to the paper-supplying guide hanging downwardly. Two springs pressing the image-read out device against the conveying roller are almost equal to each other in energizing force and are arranged such that the distance from the middle roller portion toward that spring by the paper-supplying guide is almost equal to the distance from the middle roller portion to the other spring, with a slight difference between such distances.

We claim:

1. In a paper supplying device for use in an image forming machine, said device including a conveying roller for conveying papers to be supplied and having an axial length to act on the papers over the entire width thereof, a paper supplying roller positioned upstream of said conveying roller for feeding the papers to said conveying roller and capable of being inoperative at times of operation of said conveying roller, said paper supplying roller having an axial length to contact only a central portion of the paper in the direction of the width thereof, and an overlapped conveyance prevention member urged toward said paper supplying roller for preventing feed thereby of plural papers, the improvement wherein:

said conveying roller includes a middle portion and opposite axial end portions all operable for conveying the paper, said middle portion having an axial length less than the width of the paper, and said middle portion having a diameter larger than diameters of said end portions; and a center in the axial direction of said middle portion approximately coincides with a center in the axial direction of said paper supplying roller.

2. The improvement claimed in claim 1, further comprising a paper supplying guide positioned to guide and regulate one side edge of the paper being supplied, said middle portion of said conveying roller being axially offset in a direction toward said paper supplying guide.

3. The improvement claimed in claim 2, further comprising an image read-out device urged toward said conveying roller along the entire axial length thereof by a pair of springs spaced axially thereof and located at positions on opposite axial sides of said center of said middle portion of said conveying roller. a first said spring on the axial side of said center of said middle portion opposite said paper supplying guide being spaced from said center of said middle portion by a first axial distance, a second said spring on the same axial side of said center of said middle portion as said paper supplying guide being spaced from said center of said middle portion by a second axial distance, and said first axial distance being greater than said second axial distance.

* * * * *